United States Patent [19]

Nakao

[11] Patent Number: 4,962,713

[45] Date of Patent: Oct. 16, 1990

[54] PLURAL SEWING MACHINE ARRANGEMENT FOR SEWING BROAD CLOTH PIECES

[75] Inventor: Kozo Nakao, Wakayama, Japan

[73] Assignee: Queen Light Electronic Industries, Ltd., Wakayama, Japan

[21] Appl. No.: 313,635

[22] Filed: Feb. 22, 1989

[30] Foreign Application Priority Data

Nov. 24, 1988 [JP] Japan ..... 63-296568

[51] Int. Cl.[5] ..... D05B 21/00

[52] U.S. Cl. ..... 112/155; 112/260

[58] Field of Search ..... 112/155, 260, 121.12

[56] References Cited

U.S. PATENT DOCUMENTS

| | | | |
|---|---|---|---|
| 3,783,811 | 1/1974 | Schmedding et al. | 112/155 X |
| 4,432,295 | 2/1984 | Raisin et al. | 112/155 |
| 4,635,574 | 1/1987 | Fujita et al. | 112/155 X |
| 4,665,849 | 5/1987 | Kelly | 112/155 |

FOREIGN PATENT DOCUMENTS

| | | | |
|---|---|---|---|
| 3267390 | 11/1988 | Japan | 112/155 |

*Primary Examiner*—Andrew M. Falik

*Attorney, Agent, or Firm*—Jones, Tullar & Cooper

[57] ABSTRACT

Sewing apparatus, uses plural sewing machines aligned in a row so that the feeding direction of the cloths to be sewn is parallel, each sewing machine having a bed with an upper surface, an arm with a base end part formed coupled to the bed and a needle location. Each base end part having a shape, when viewed orthogonal to the cloth feeding direction, which approximates a Z-form possessing a partition wall the upper surface of which is parallel to the upper surface of the bed. The relay sewing process of sewing the side ends of adjacent broad cloths in an overlapped state can be performed simultaneously on plural cloths arranged in the lateral direction.

8 Claims, 7 Drawing Sheets

PLURAL SEWING MACHINE ARRANGEMENT FOR SEWING BROAD CLOTH PIECES

BACKGROUND OF THE INVENTION

1. Field of the Invention:

This invention relates to a sewing equipment apparatus ideal for sewing sheet material having an extremely vast area, and more particularly to sewing apparatus capable of performing a so-called relay sewing process for sewing together the side end parts of adjacent broad cloths overlapped together, simultaneously for a plurality of cloths laid in the lateral direction.

2. Prior Art:

A sewing machine capable of performing the so-called relay sewing process of sewing with each edge part of two broad cloths overlapped with each other without folding the cloths is disclosed in Japanese Patent No. 1,232,866. The sewing machine disclosed in this publication is constructed as shown in FIG. 9, that is, a base end part 502*a* of an arm 502 to be set up on a bed 501 is disposed at the nearer side (arrow F side) of a needle location P', and this base end part 502*a* of the arm 502 is formed so that the shape of the section orthogonally intersecting with the cloth feeding direction may be approximately in a Z-form. In the sewing machine thus constructed, when feeding the cloths to the needle location side, each cloth to be sewn can individually pass through the upper side and lower side of the orthogonal part with the cloth feeding direction in the base end part in the approximately Z-form, so that all cloths may be smoothly sewn without having to be folded back.

Conventionally, however, in such a relay sewing process, an operator is used to join the side ends of two fabrics and assists by forwarding the cloths into the needle location by hand along with the feeding operation of the sewing machine.

Recently, to be, the cloth products to be formed by such a relay sewing process tend to be larger in size as compared with the former ones, as represented, for example, by a large-sized bellows type tent. These large cloth products can no longer be manufactured efficiently by such a method of sewing every two cloths. It is expected that such a problem will be solved when three or more cloths are sewn in the relay sewing process, but in the conventional general sewing machines, that is, in the machines having the base end part of the arm coupled to the bed at the side of the needle location this base end part, however, is an obstacle, so that the job of plaiting down the cloth located at the base end side of the arm from the needle location is needed, and because of this it was actually not considered possible to perform a relay sewing process simultaneously on three or more cloths.

SUMMARY OF THE INVENTION

To solve the above problems, it is a primary object of this invention to provide sewing apparatus capable of producing extremely large cloth products efficiently by performing the relay sewing process of three or more cloths simultaneously, on the basis of the idea of carrying out the relay sewing process without plaiting down the cloths in the sewing machine disclosed in the above noted Japanese Patent No. 1,232,866.

It is another object of this invention to provide sewing apparatus capable of more efficient production by designing so that the cloth sent out from the material side may move automatically from the nearer side to the farther side of the sewing machine along with the sewing steps.

An important feature of the sewing apparatus of the invention lies in the structure comprising plural sewing machines having the base end part of the arm set up on the bed disposed at the nearer side of the needle location and formed so that the shape of the section orthogonal to the cloth feeding direction of this base end part may be approximately in a Z-form possessing a partition wall parallel to the bed upper surface. These sewing machines are arranged parallel in the lateral direction so that each cloth feeding direction may be parallel, and the base end parts of the adjacent sewing machines are coupled to the bed at the opposite right and left sides of each sewing machine regarding the line segment parallel to the cloth feeding direction passing through the needle location of each sewing machine.

In the thus constructed sewing apparatus, the adjacent sewing machines can sew, on both sides of a piece of cloth passing at the upper side or lower side of the partition wall of the both base end parts, cloths passing at the opposite side of the respective partition walls to this cloth in each sewing machine. At this time, the cloths at both sides are overlaid on the same surface of the central cloth. Therefore, according to the sewing apparatus of this invention, at least three cloths can be simultaneously processed by relay sewing, and the production efficiency is significantly enhanced. Besides, these three cloths are overlaid alternately up and down, they do not descend in one direction as seen from the front, so that a flat product may be obtained on the whole.

Another feature of the sewing apparatus of this invention is as follows: the sewing machines have their coupling parts of the bed and arm base end part disposed below the needle location forming plane of the bed, and an ascending slope from the front end of the coupling part to the needle location side is formed on the bed, and the upper surface of the crossing part with the cloth feeding direction in the approximately Z-form base end part is positioned on the plane nearly level with the needle location forming plane.

In such sewing apparatus, one cloth is fed into the needle location of each sewing machine along the slope, while the other cloth is fed along the plane nearly level with the needle location. Therefore, before the needle location, no processing is needed on both cloths, and the cloths can be directly laid over mutually before the needle location. In other words, broad cloths can be sewn without having to plait them down, and such overlaying of cloths in the sewing process can be done spontaneously along with the movement of the cloths by the cloth feeding operation. Therefore, without requiring any particular overlaying mechanism, a sewing apparatus with an extremely high job efficiency can be realized at a low cost.

A still different feature of the sewing apparatus of the invention is that the sewing machines are for double chain sewing. That is, in the rear part behind the base end part on the slope of each sewing machine, an opening is formed which is normally closed by the detachable cover and is open to expose the inside-of the bed when the cover is removed, and a looper which is disposed in the bed and is normally in a sewing state is designed to be tiltable to the opening side.

In this construction, by inserting a hand into the bed from the opening formed in the slope directed to the front side in the rear part behind the arm base end part, the looper thread can be connected to the looper tilted to the opening side. Therefore, although the arm base end part is located ahead of the needle location, the looper thread connection job to the looper can be done extremely easily, and job efficiency may be notably enhanced.

In a further different embodiment of the sewing apparatus of this invention, a device for feeding into the needle location of each sewing machine in a state of overlaying the side end parts of the adjacent cloths with a cloths wound up from the material roll is disposed at the nearer side in the cloth feeding direction of each sewing machine, while a forward feeding device for feeding the sewn cloths to the rear side is disposed at the rear side in the cloth feeding direction of each sewing machine.

In the sewing in such a manner, the adjacent side end parts of the cloths wound up from the material roll are automatically overlapped along with the feeding action by the sewing operation of each sewing machine, and the cloths are sent into the needle location in this state, and the overlapped portion is sewn. Therefore, very broad cloths can be automatically sewn without requiring manual labor.

DETAILED DESCRIPTION OF THE PREFERRED EMBODIMENTS

Figure 1:
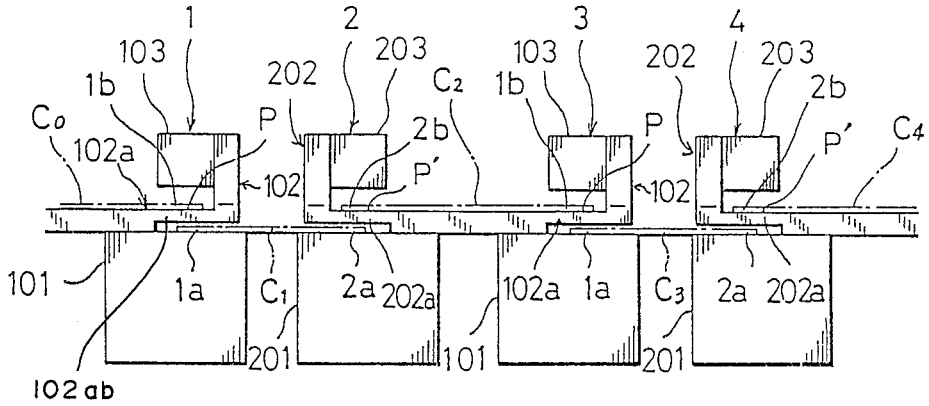
FIG. 1 is a schematic front view of a sewing apparatus, according to the present invention.
Figure 3:
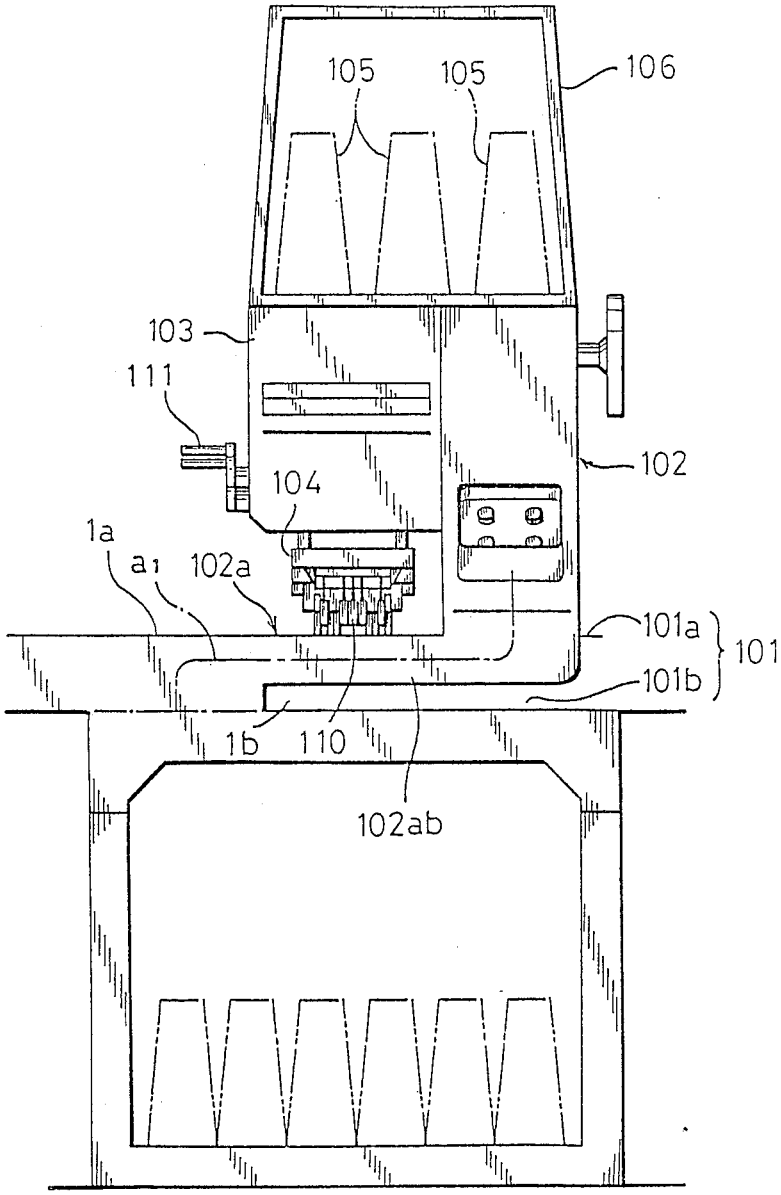
FIG. 3 is a front view of a first sewing machine.
Figure 4:
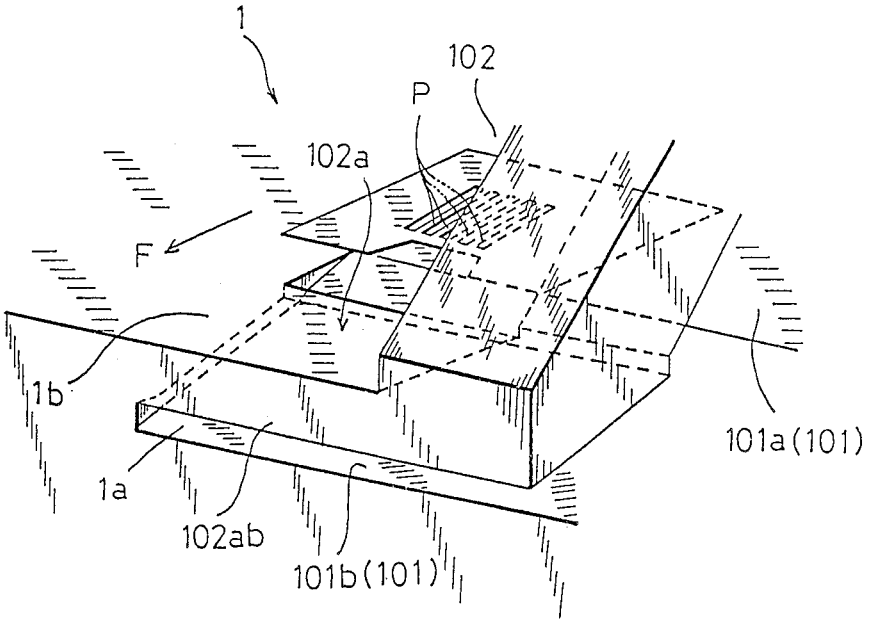
FIG. 4 is a perspective view of a portion of the sewing machine of FIG. 3 illustrating essential parts thereof.

Referring now to FIG. 1, numerals 1 to 4 are first to fourth sewing machines comprising the sewing apparatus. These sewing machines 1 to 4 may be represented by the first sewing machine as explained in FIG. 3 and FIG. 4. In FIGS. 3 and 4, numeral 101 is a bed, and 102 is an arm integrally set up on this bed 101.

The upper surface of the bed 101 is composed of a horizontal plane 101*a* forming the rear side, and a sloped plane or slope 101*b* tilting downward toward the near side (arrow F side in FIG. 4) to form the front side of the needle location P of the sewing machine.

The base end part 102*a* of the arm 102 is formed so that the shape of the section orthogonally crossing with the cloth feeding direction is approximately in a Z-form as estimated from the single-dot chain line $a_1$ in FIG. 3. At the same time, this base end part 102*a* is located at the nearer side (arrow F side) by a specified distance from the needle location P, on an extension from the needle center line parallel to the cloth feeding direction passing the needle location P. In other words, since the base end part 102*a* is located at the near side by the specified distance from the needle location P, it is integrally connected to the bed 101 at-the left end of the slope 101*b* of the bed 101 located to the left side, avoiding the needle center line. The base end part 102*a* approximately in Z-form is provided with a partition wall 102*ab* corresponding to a parallel portion to the upper surface of the bed 101. This partition wall 102*ab* is formed so as to be orthogonal to the cloth feeding direction, so that its upper surface may be positioned on the same plane as the horizontal plane 101*a* of the bed 101. Since the base end part 102*a* of the arm 102 is constructed in this way, the first sewing machine 1 is furnished with a lower cloth passage 1*b* at the lower side of the partition wall 102*ab*, and an upper cloth passage 1*a* at the upper side of the partition wall 102*ab*.

Figure 2:
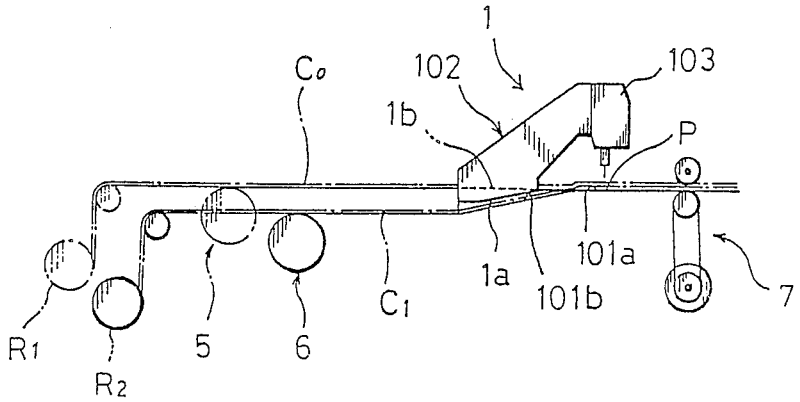
FIG. 2 is a schematic side view which explains the cloth feeding mechanism.

As shown in FIG. 2, the front end of the arm 102 is extended above the needle location P, and an arm head 103 is located in this part. Then, as shown in FIG. 3, from the arm head part 103 to the needle location P side, a needle mounting part 104 for mounting a sewing needle (not shown) on the front end projects. In FIG. 3, what is fixed on the upper face of the arm head 103 is a bobbin box 106 for mounting needle thread bobbins 105.

Figure 6:
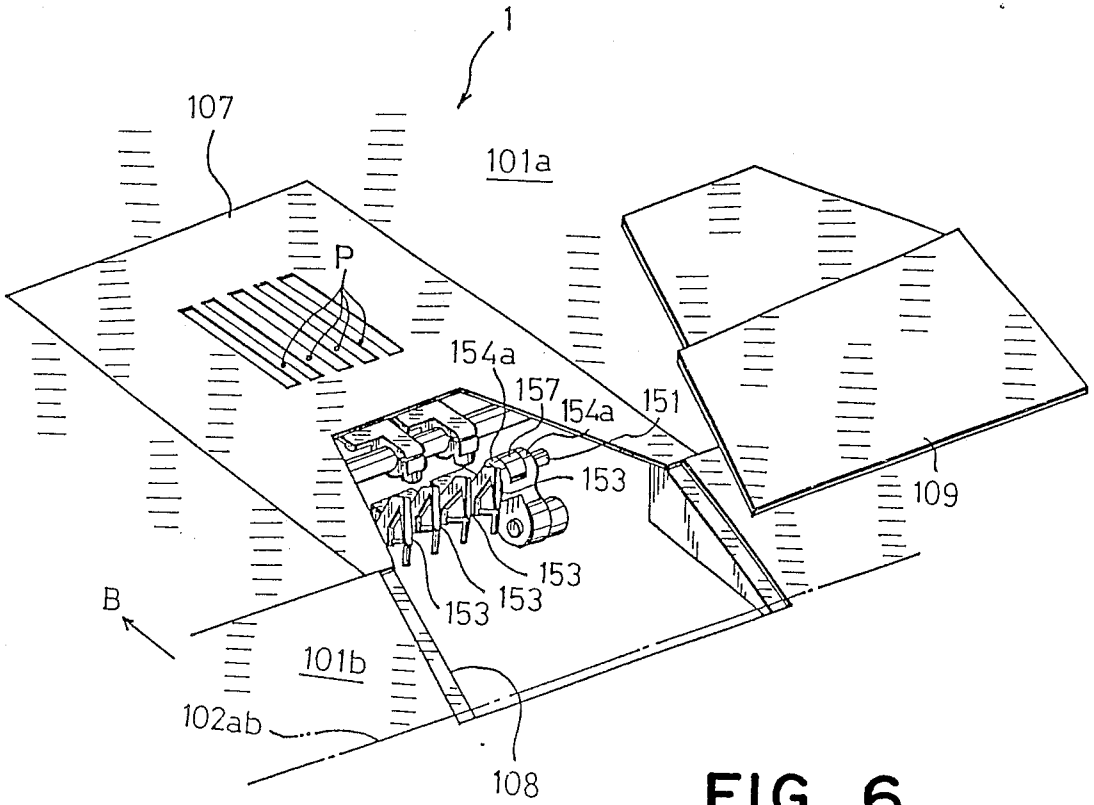
FIG. 6 is a perspective view of a portion of the sewing machine of FIG. 3 illustrating an opening therein.

In the horizontal plane 101*a* of the bed 101, a known throat plate 107 is set in the portion including the needle location P forming area as shown in FIG. 6. On the boundary of the horizontal plane 101*a* and slope 101*b* positioned at the rear side (arrow B side) behind the base end part 102*a*, an opening 108 the horizontal plane 101*a* side of which is trapezoidal and the slope 101*b* side is rectangular, is formed. As clear from FIG. 6, in the sewing machine used in the sewing equipment shown in the illustrate example, the opening 108 is in contact with the throat plate 107 at the horizontal plane 101*a* side. That is, the throat plate 107 is notched so that its front side may be trapezoidal. In this opening 108, a cover 109 which is level with the horizontal plane 101*a* and slope 101*b* in the mounted state is detachably inserted.

Numeral 110 denotes pressor feet for pressing down the cloths supplied on the throat plate 107, and they are attached to the front end of the rod (not shown) projecting from the arm head 103, and are designed to be moved up and down by operating the lever 111 disposed at the side of the arm head 103.

Beneath the throat plate 107, there are disposed plural loopers 153, which can be tilted to the front side, that is, to the lower side of the opening 108 by the mechanism disclosed in the Japanese Utility Model No. 1,627,126.

Figure 7:
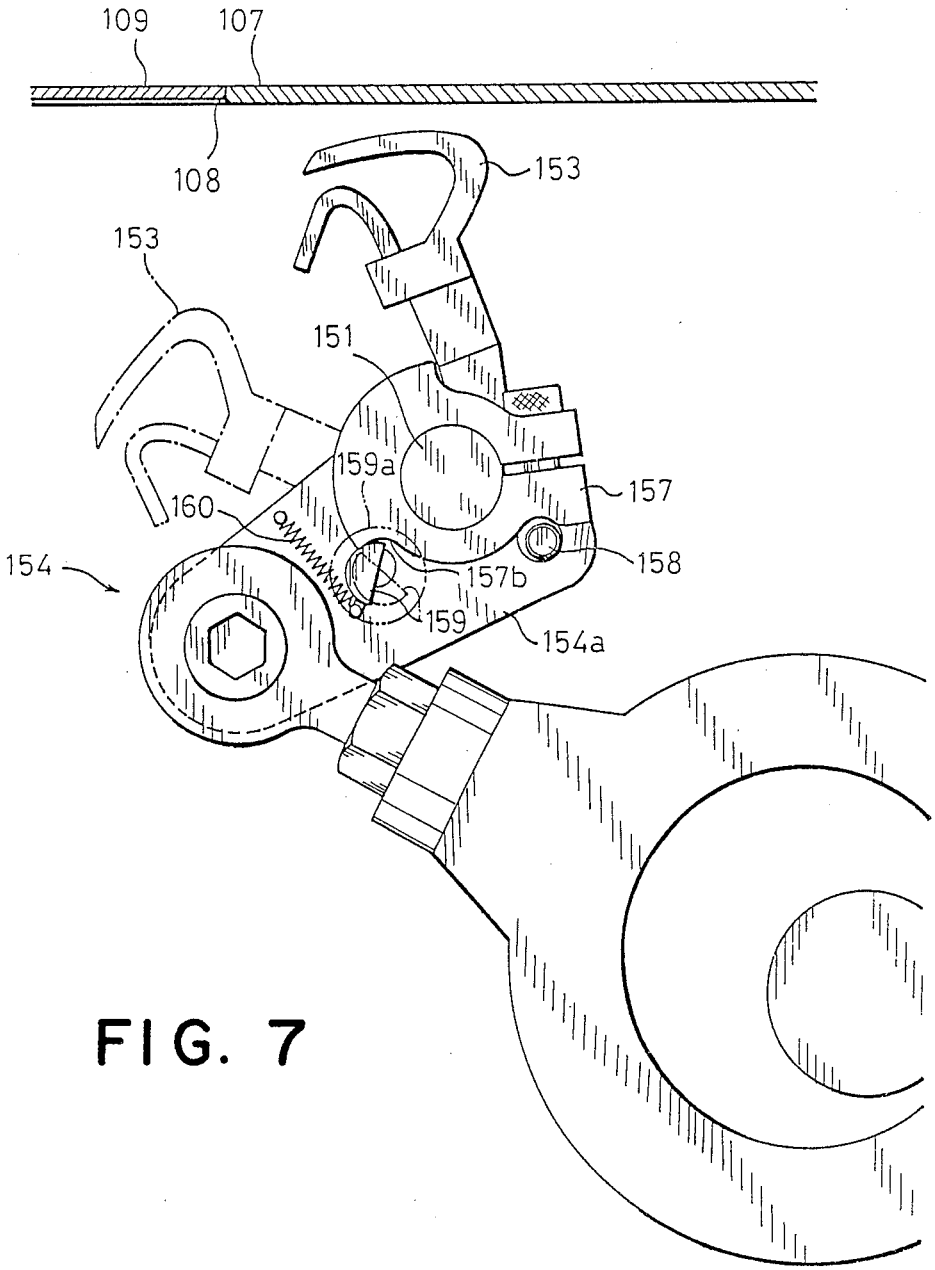
FIG. 7 is an explanatory illustration of a looper tilting mechanism located in the opening of FIG. 6.

This looper tilting mechanism is described below with reference to FIG. 7.

The plural loopers 153 are mounted on a looper shaft 151, and this looper shaft 151 is rotatably inserted into bifurcated crank arms 154*a*, 154*a* of a crank mechanism 154. Between the bifurcated crank arms 154*a*, 154*a*, a cam body 157 to be fixed on the looper shaft 151 is disposed as shown also in FIG. 6. Between the bifurcated crank arms 154*a*, 154*a*, moreover, a columnar pin 158, which penetrates through in a rotatable state and an eccentric pin 159 disposed ahead of this pin 158, are provided. The eccentric pin 159 is rotatable between a locking position to be engaged with an engaging concave part 157*b* formed on the outer circumference of the cam body 157 in a pressed state, and an unlocking position departing from the outer circumference of the cam body 157. On this eccentric pin 159, a knob 159*a* projecting outwardly of one crank arm 154*a* is formed integrally, and by manipulating this knob 159*b* by a finger, the eccentric pin 159 is rotated between the locking position and the unlocking position. When the knob 159*a* is turned until the eccentric pin 159 is engaged with the engaging concave part 157*b* of the cam body 157 as indicated by solid line in FIG. 7, the cam body 157 is fixed at a specified position by the pin 158 and eccentric pin 159, so that the looper shaft 151 is locked at the sewing position. When the knob 159*a* is turned in the reverse direction until the eccentric pin 159 is departed from the outer circumference of the cam body 157 as indicated by the single-dot chain line in FIG. 6, the confinement by the eccentric pin 159 is released, and the cam 157 fixed on the looper shaft 151 is set free (unlocked), and the looper 153 affixed on the looper shaft 151 can turn forward as indicated by the single-dot chain line. A coil spring 160 provides an elastic force for deviating the eccentric pin 159 to the engaging concave part 157*b* of the cam body 157.

As compared with the thus constructed first sewing machine, the third sewing machine 3 is exactly identical with this first sewing machine 1.

On the other hand, the second sewing machine 2 and the fourth sewing machine 4, which are not illustrated in detail, are formed so that their base end parts may be symmetrical to the first and third sewing machines 1, 3 as seen from the front side. That is, as evident from FIG. 1, in the first and third sewing machines 1, 3, the base end part 102*a* is linked to the left side of the bed 101 relating to the needle location P as seen from the front side, and the front end of the arm 102 comprising the arm head part 103 is extended upward at the right side of the bed 101 across the needle location P. By contrast, in the second and fourth sewing machines 2, 4, the base end part 202*a* is coupled to the right side of the bed 201 of these sewing machines 2, 4 with respect to the needle location P′, and the front end of the arm 202 is extended upward at the left side of the bed 201 across the needle location P′. However, unless otherwise specified, the parts of the third sewing machine 3 in FIG. 1 are identified with the same reference numbers as the first sewing machine, and the parts of the second and fourth sewing machines 2, 4 corresponding to the parts of the first sewing machine 1 are provided with the reference numbers by replacing the first digit from 1 to 2 of those of the first sewing machine.

As seen from FIG. 1, the first and fourth sewing machines 1 to 4 are arranged parallel in the lateral direction so that the respective cloth feeding directions may be parallel to each other. Also as evident from the description herein, the adjacent sewing machines, that is, the first sewing machine 1 and the second sewing machine 2, the second sewing machine 2 and the third sewing machine 3, and the third sewing machine 3 and fourth sewing machine 4 are arranged so that the respective base parts may be symmetrical to each other. Furthermore, the lower cloth paths 1*a*, 2*a* and the upper cloth paths 1*b*, 2*b* of the sewing machines 1 to 4 are arranged at the same height individually.

Figure 8:
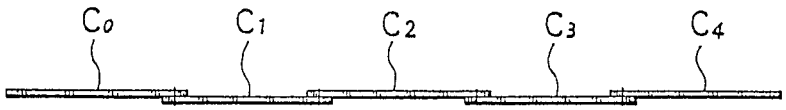
FIG. 8 is an explanatory illustration of the product state after a relay sewing process by the sewing apparatus off the present invention.
Figure 9:
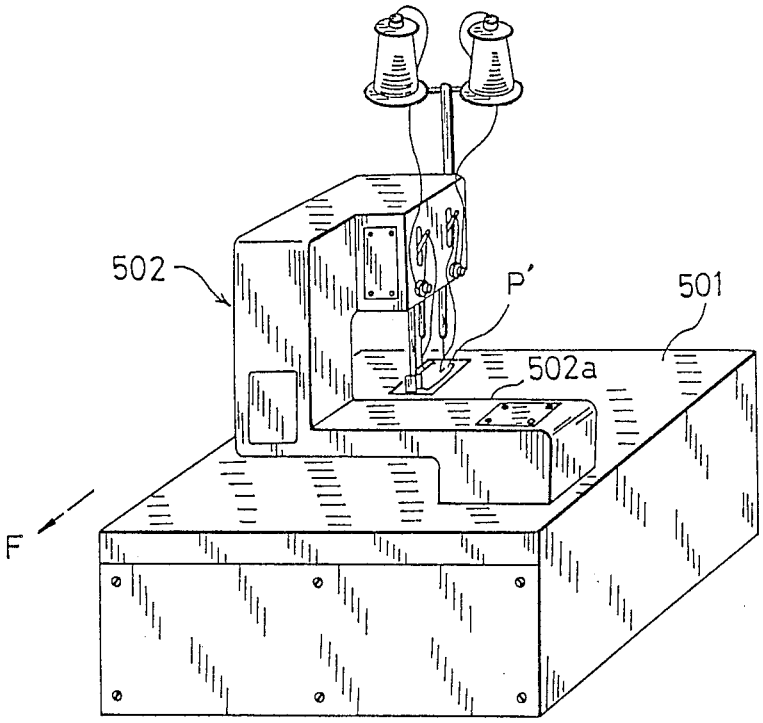
FIG. 9 PRIOR ART
FIG. 9 is a schematic perspective view showing a prior art sewing machine.

When the sewing machines are configured as described above, as shown in FIG. 1, a cloth $C_1$ taken from one material roll stand (not shown) can pass both the lower cloth path 1*a* of the first sewing machine 1 and the lower cloth path 2*a* of the second sewing machine. Likewise, a cloth $C_2$ taken from one material roll stand can pass through the upper cloth path 2*a* of the second sewing machine 2 and the upper cloth path 1*b* of the third sewing machine 3, and a cloth $C_3$ taken from one material roll stand can pass through the lower cloth path 1*a* of the third sewing machine 3 and the lower cloth path 2*a* of the fourth sewing machine 4. Therefore, a total of five cloths including the cloth $C_0$ passing through the upper cloth path 1*b* of the first sewing machine, and the cloth $C_4$ passing through the upper cloth path 2*b* of the fourth sewing machine 4 are simultaneously subjected to a relay sewing process in the vertically and alternatley overlaid state. Accordingly, the product after relay sewing process by the sewing apparatus in this way has the individual cloths $C_0$ to $C_4$ sewn up and down alternately at the side end parts as shown in FIG. 8.

In such a sewing apparatus, since it is not necessary to plait down the cloths taken into the sewing machines, as an example of which the first sewing machine 1 is shown in FIG. 2, the sewing process can be done automatically, by taking the cloths $C_0$ to $C_4$ from the material rolls R1, R2 by the take-out devices 5, 6, and delivering the clots to the sewing machine side, and by sending these cloths sewn by the sewing machines 1 to 4 further to the next process side by the forward feeding device 7 disposed behind the sewing machines.

Figure 5:
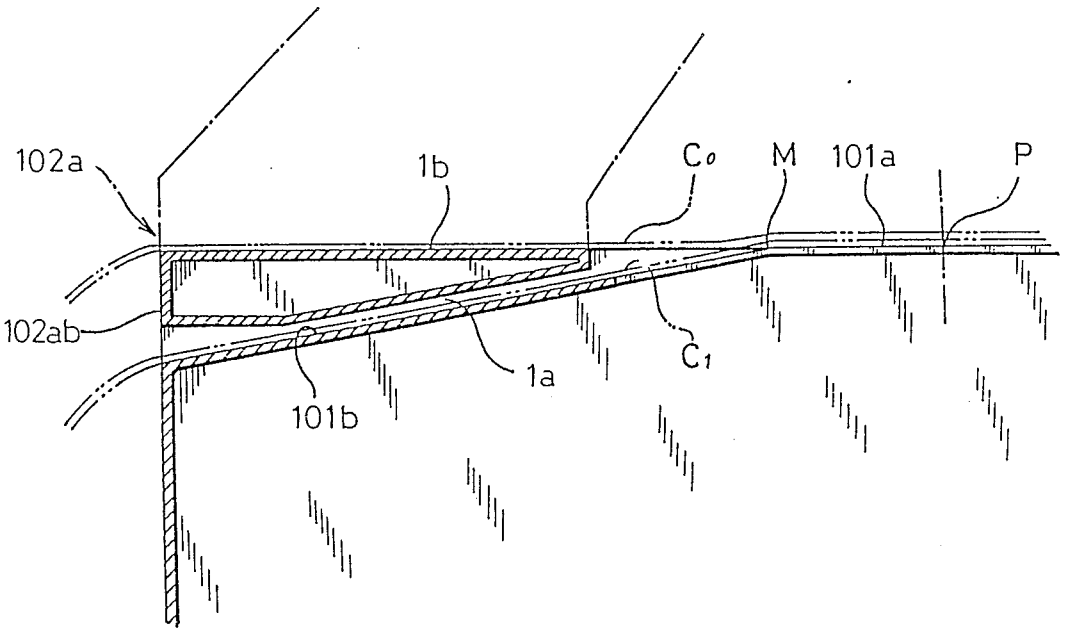
FIG. 5 is a magnified sectional view of a portion of the sewing machine of FIG. 3 which explains the overlapped state of cloths in individual sewing machines.

In such a sewing apparatus, as shown in FIG. 5, since the upper surface of the partition wall 102*ab* composing the upper cloth path 1*b* is position in the same plane as the horizontal plane 101*a* of the bed 101, while the upper cloth path 1*b* converges with the lower cloth path 1*a* composed of the slope 101*b* of the bed 101 before the needle location P, the side end parts of the cloths $C_0$, $C_1$ are mutually overlaid at the convergent point M of the cloth paths 1*a*, 1*b* and forwarded into the needle location P by the feeding operation accompanying the sewing motion. When the end parts overlaid in this way are sent into the needle location P, both cloths $C_0$ $C_1$ are sequentially subjected to a relay sewing process. In other words, according to this sewing apparatus, not only the trouble of plaiting down the cloths is avoided, but also any particular mechanism for overlaying is not needed although the cloths are fed from the different positions in the vertical direction. Therefore, by installing the feeding devices 5, 6 and forward feeding device 7 as mentioned above, the relay sewing process using a plurality of cloths can be done automatically.

Furthermore, with such a construction, for example, by removing the cover 109 positioned before the needle location P to open the opening 108 straddling the horizontal plane 101*a* and slope 101*b* of the bed 101, the crank arms 154*a*, 154*a* of the crank mechanism installed inside the bed 101 can be exposed from the opening 108. Since this opening 108 is formed in the slope 101*b* opposite the front side, the operator can easily put his hand into the bed 101 through this opening 108 from the front side, and can manipulate the knob 159*a* of the eccentric pin 159. Therefore, it is easy to cancel the engagement between the eccentric pin 159 and the engaging concave part 157*b* of the cam body 157. However, the mechanism for tilting the looper may not be necessarily as shown in FIG. 7, but the design may be modified in various manners.

When the looper 153 is tilted to the front side in this way, the looper 153 moves to below or near the corresponding part of the horizontal plane 101*a* of the opening 108, and by inserting a hand into the bed 101 from the opening 108, as in the case of manipulation of the knob 159*a* noted above, the looper thread may be easily connected to the looper 153. In this case, too, since the opening 108 is formed in the corresponding part of the slope 101*b*, the operator can easily put his hand into the bed 101 from the front side. Hence, in the sewing machines composing the sewing apparatus, the loop thread connecting work can be done in a spontaneous position beside the looper 153.

After the looper thread connection work, the knob 159*a* is operated again and the eccentric pin 159 is engaged with the engaging concave 157*b* of the cam body 157, and the cam body 157 is fixed by this eccentric pin 159 and pin 158, and hence the looper 153 is locked to a crank arms 154*a*, 154*a*, so that sewing operation is ready.

In a sewing machine for lock stitch not provided with loopers, the opening 108 is not needed. In this case, the cloths to be sewn can be overlaid without any particular mechanism, and the cloth is fed smoothly.

In this sewing apparatus, at least two sewing machines should be configured so that the coupling parts with the bed connected to the partition wall of the base end parts may be positioned opposedly at right and left sides of a line segment parallel to the cloth feeding direction passing through the needle location in each sewing machine. Each sewing machine may share the bed, or the bed of each sewing machine may be coupled by using other members. Furthermore, the numbers of sewing machines may be either equal or unequal.

What is claimed is:

1. A sewing apparatus for sewing broad cloth pieces, comprising:

a plurality of sewing machines aligned in a row so that the feeding direction of the cloths to be sewn is parallel, each sewing machine having a bed with an upper surface, an arm with a base end part formed coupled to said bed, and a needle location, each said base end part having a shape, when viewed orthogonal to the feeding direction of the cloths, which approximates a Z-form possessing a partition wall, the upper surface of which is parallel to the upper surface of said bed, the base end part of adjacent sewing machines being coupled to their respective beds at the right and left opposite sides of the needle location of their respective beds.

2. The sewing apparatus as defined in claim 1 wherein the needle location defines a needle location forming plane, wherein the base end part of each arm is coupled to its respective bed beneath the needle location forming plane of its respective machine, wherein a sloped surface is defined from the end of the machine where the base end part of each arm is coupled to its perspective bed to the needle location forming plane and wherein the upper surface of the partition wall is nearly coplanar with said needle location forming plane.

3. The sewing apparatus as defined in claim 2, wherein each sewing machine includes an opening formed in the bed and a detachable cover for closing said opening, said opening having a looper mounted in a sewing state therein, to be tiltable from the sewing state outwardly of the opening.

4. The sewing machine as defined in claim 3, further comprising:

a feeding device for feeding cloth into the needle location of each machine such that the side ends of adjacent cloths overlap; and a forward-feeding device for feeding the sewn cloth downstream of the needle location.

5. The sewing machine as defined in claim 2, further comprising:

a feeding device for feeding cloth into the needle location of each machine such that the side ends of adjacent cloths overlap; and a forward-feeding device for feeding the sewn cloth downstream of the needle location.

6. The sewing apparatus as defined in claim 1, wherein each sewing machine includes an opening formed in the bed and a detachable cover for closing said opening, said opening having a looper mounted in a sewing state therein, to be tiltable from the sewing state outwardly of the opening;

7. The sewing machine as defined in claim 6, further comprising:

a feeding device for feeding cloth into the needle location of each machine such that the side ends off adjacent cloths overlap; and a forward-feeding device for feeding the sewn cloth downstream of the needle location.

8. The sewing machine as defined in claim 1, further comprising:

a feeding device for feeding cloth into the needle location of each machine such that the side ends of adjacent cloths overlap; and a forward-feeding device for feeding the sewn cloth downstream of the needle location.

* * * * *